United States Patent [19]

Yamada

[11] Patent Number: 4,559,420

[45] Date of Patent: Dec. 17, 1985

[54] OMNIDIRECTIONAL CHANGEOVER SWITCH

[75] Inventor: Toshiaki Yamada, Miyagi, Japan

[73] Assignee: Alps Electric Co., Ltd., Japan

[21] Appl. No.: 660,504

[22] Filed: Oct. 12, 1984

[30] Foreign Application Priority Data

Oct. 14, 1983 [JP] Japan ..... 58-157939[U]

[51] Int. Cl.[4] ..... H01H 19/08

[52] U.S. Cl. ..... 200/6 A; 200/11 DA

[58] Field of Search ..... 200/6 A, 11 G, 11 DA; 74/471 XY; 340/709

[56] References Cited

U.S. PATENT DOCUMENTS

| | | | |
|---|---|---|---|
| 3,870,986 | 3/1975 | Oka et al. | 200/6 A X |
| 3,942,148 | 3/1976 | Nishioka | 74/471 XY X |
| 4,161,726 | 7/1979 | Burson et al. | 74/471 XY X |
| 4,297,542 | 10/1981 | Shumway | 200/6 A |

*Primary Examiner*—A. D. Pellinen
*Assistant Examiner*—Morris Ginsburg
*Attorney, Agent, or Firm*—Guy W. Shoup

[57] ABSTRACT

An omnidirectional changeover switch includes casing having adjacent sides, at least a pair of switch units mounted respectively on the sides and having rotatable slider supports, respectively, a control lever mounted in the casing, and interlink members disposed in the casing and rotatable about their own axes extending in substantially perpendicular relation to each other, the control lever being operatively connected to the slider supports through the interlink members, each of the slider supports comprising an insulating base and supporting a pair of sliders slidable on the insulating base, the base including a collector held in contact with one of the sliders at all times, and a pair of contacts capable of contacting the other slider and having ends held in confronting relation to each other, the collector and the contacts being printed as patterns on the insulating base.

3 Claims, 6 Drawing Figures

Fig. 6

| DETECTED DIRECTION | ON POSITION OF SW1 | | ON POSITION OF SW2 | |
|---|---|---|---|---|
| | $A_1$ | $B_1$ | $A_2$ | $B_2$ |
| T | 1 | 0 | 0 | 0 |
| NEAR TR | 1 | 0 | 1 | 0 |
| R | 0 | 0 | 1 | 0 |
| NEAR RB | 0 | 1 | 1 | 0 |
| B | 0 | 1 | 0 | 0 |
| NEAR BL | 0 | 1 | 0 | 1 |
| L | 0 | 0 | 0 | 1 |
| NEAR LT | 1 | 0 | 0 | 1 |
| O | 0 | 0 | 0 | 0 |

OMNIDIRECTIONAL CHANGEOVER SWITCH

BACKGROUND OF THE INVENTION

The present invention relates to an omnidirectional changeover switch for controlling an object in response to movement of a control lever as it is tilted.

Various switches of the type described have heretofore been proposed, but still suffer from problems. For example, one known omnidirectional changeover switch comprises a control lever and a plurality of switch units operatively interconnected through interlink members so that switch units can be actuated in response to movement of the control lever for omnidirectional switching operation. Each of the switch units used employs a leaf spring for changeover between two contacts. With the leaf switch used for switching between the contacts, however, it is difficult to achieve desired timing between omnidirectional movement of the control lever and contact between the contacts.

SUMMARY OF THE INVENTION

It is an object of the present invention to provide an omnidirectional changeover switch which can easily achieve switching timing and can be assembled with ease.

According to the present invention, there is provided an omnidirectional changeover switch including casing having adjacent sides, at least a pair of switch units mounted respectively on the sides and having rotatable slider supports, respectively, a control lever mounted in the casing, and interlink members disposed in the casing and rotatable about their own axes extending in substantially perpendicular relation to each other, the control lever being operatively connected to the slider supports through the interlink members, each of the slider supports comprising an insulating base and supporting a pair of sliders slidable on the insulating base, the each slider support further comprising a collector held in contact with one of the sliders at all times, and a pair of contacts capable of contacting the other slider and having ends held in confronting relation to each other, the collector and the contacts being printed as patterns on the insulating base.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 6 is a table showing the relationship between the directions of movement of the control lever and ON and OFF states of the contacts.

DESCRIPTION OF THE PREFERRED EMBODIMENT

Figure 3:
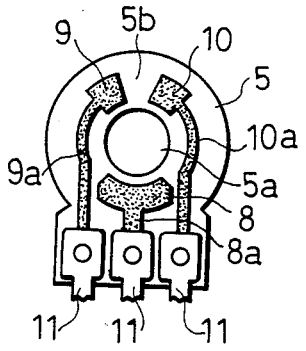
FIG. 3 is a front elevational view of a base.
Figure 4:
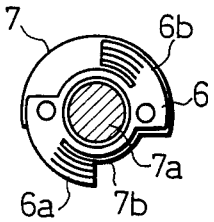
FIG. 4 is a front elevational view, partly in cross section, of a slider support.

An omnidirectional changeover switch includes a casing 1 of an insulating material with an open bottom, and switch units 2, 3 attached to adjacent sides 1*a*, 1*b* of the casing 1. The switch units 2, 3 are actuated for switching by a control lever 4 projecting through a dish-shaped recess 1*d* defined in an upper surface 1*c* of the casing 1. Each of the switch units 2, 3 is composed of a base 5 (FIG. 3) and a slider support 7 to which sliders 6 (FIG. 4) are fixed. The base 5 is made of an insulating material and supports thereon a printed collector 8 below a peripheral edge of a central through hole 5*a*, a pair of printed confronting contacts 9, 10 above the hole 5*a*, and printed leads 8*a*, 9*a*, 10*a* connected between the collector 8, the contacts 9, 10 and terminals 11 respectivey therefor. The collector 8, the contacts 9, 10, and the leads 8*a*, 9*a*, 10*a* are printed as desired patterns. The slider support 7 has a shaft 7*a* having an end fixed to interlink members 12, 13 (described later on) and a support portion 7*b* to which the sliders 6 are secured. The sliders 6 are provided in a diameterically opposite pair across the shaft 7*a*. One of the sliders 6*a* is held in contact with the collector 8 at all times, while the other slider 6*b* can contact the contacts 9, 10 and be positioned on an insulating portion 5*b* between the contacts 9, 10 dependent on the movement of the control lever 4.

Figure 1:
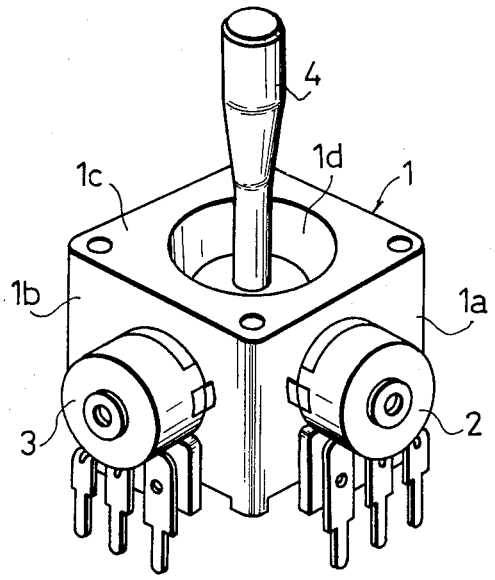
FIG. 1 is a perspective view of an omnidirectional changeover switch according to the present invention.
Figure 2:
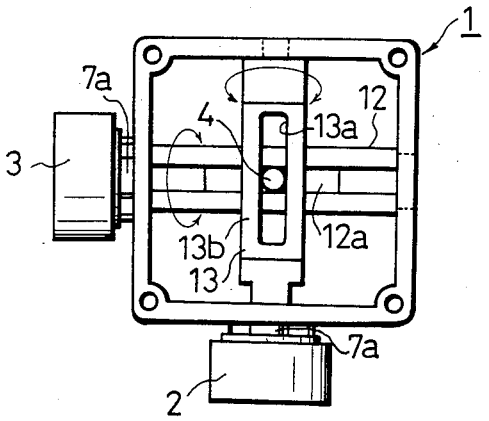
FIG. 2 is a bottom view of the omnidirectional changeover switch.

As shown in FIG. 2, the shafts 7*a* are fixed respectively to interlink members 12, 13 supported by side walls of the casing 1 for rotation in the directions of the arrows. One of the interlink members 12 is in the form of a shaft having a central groove 12*a*, while the other interlink member 13 is in the form of a plate having a central groove 13*a* and has a central curved portion 13*b*, providing a clear space for allowing the interlink member 13 to rotate about an axis at a right angle to the interlink member 12. The control lever 4 is inserted through the central grooves 12*a*, 13*a* in the interlink members 12, 13. Although not shown, a spring is mounted on the slider support 7 for normally urging the control lever 4 toward a central position.

Only the interlink member 12 is rotated in response to vertical movement (FIG. 2) of the control lever 4, and only the interlink member 13 is rotated in response to lateral movement of the control lever 4. In response to other combined motions of the control lever 4, both the interlink members 12, 13 are rotated to actuate the switch units 2, 3 for switching operation.

Figure 5:
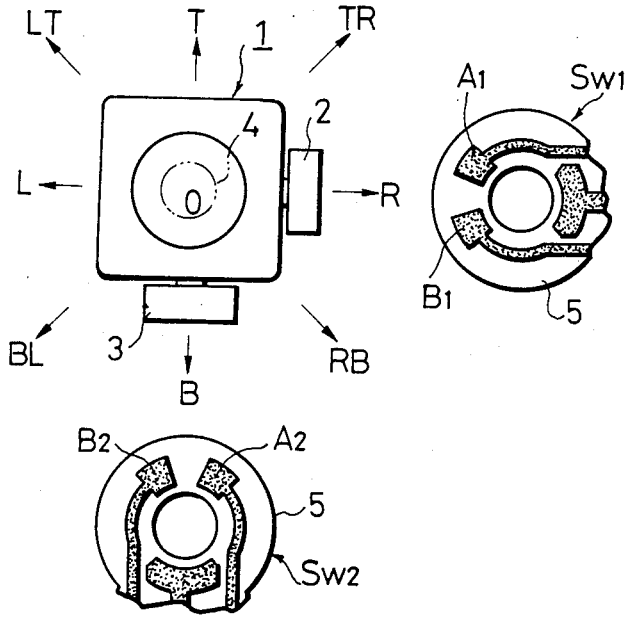
FIG. 5 is a diagram illustrative of directions in which a control lever is moved and contacts.

Changeover of the switch and detection of the direction in which the control shaft 4 is actuated will be described with reference to FIGS. 5 and 6. As shown in FIG. 5, the control lever 4 is movable in the directions of the arrows T, R, B, L and also in the intermediate directions of the arrows TR, RB, BL, LT and adjacent directions. The contacts 9, 10 of one of the switches (Sw1) 2 are indicated by $A_1$, $B_1$, while the contacts of the other switch (Sw2) 3 by $A_2$, $B_2$. As shown in FIG. 6, ON and OFF states of the contacts $A_1$, $B_1$, $A_2$, $B_2$ of the switches Sw1, Sw2 are held in a constant relationship to the directions of movement of the control lever 4. "0" and "1" in FIG. 6 indicate OFF and ON states, respectively, of the switches.

With the present invention, since the switch contacts are formed by pattern printing, desired timing of switching can more easily be achieved than is possible with conventional leaf switches. The switch of the invention is also simple in construction and easy to assemble.

Although a certain preferred embodiment has been shown and described, it should be understood that many changes and modifications may be made therein without departing from the scope of the appended claims.

What is claimed is:

1. An omnidirectional changeover switch comprising:

(a) casing having adjacent sides;

(b) at least a pair of switch units mounted respectively on said sides and having movable slider supports, respectively;

(c) a control lever mounted in said casing; and (d) interlink members disposed in said casing and movable about their own axes extending in substantially perpendicular relation to each other, said control lever being operatively connected to said slider supports through said interlink members, each of said switch units comprising an insulating base and supporting a pair of sliders slidable on said insulating base, said each base further comprising a collector held in contact with one of said sliders at all times, and a pair of contacts capable of contacting the other slider and having ends held in confronting relation to each other, said collector and said contacts being printed as patterns on said insulating base.

2. An omnidirectional changeover switch according to claim 1, wherein each said switch unit further comprises leads printed on said insulating base and connected to said collector and said contacts.

3. An omnidirectional changeover switch according to claim 1, wherein said switch units include shafts, respectively, extending centrally through said slider supports, said sliders being disposed in diametrically opposite relation to each other across said shaft.

* * * * *